US008814332B2

(12) United States Patent
Asauchi

(10) Patent No.: US 8,814,332 B2
(45) Date of Patent: Aug. 26, 2014

(54) PRINTING DEVICE

(75) Inventor: Noboru Asauchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 129 days.

(21) Appl. No.: 13/545,383

(22) Filed: Jul. 10, 2012

(65) Prior Publication Data

US 2013/0050308 A1 Feb. 28, 2013

(30) Foreign Application Priority Data

Aug. 24, 2011 (JP) ..... 2011-182236

(51) Int. Cl.
*B41J 2/175* (2006.01)

(52) U.S. Cl.
CPC ..... *B41J 2/17513* (2013.01); *B41J 2/17526* (2013.01); *B41J 2/1753* (2013.01); *B41J 2/17546* (2013.01); *B41J 2/17553* (2013.01)
USPC ..... 347/85; 347/86

(58) Field of Classification Search
CPC ..... B41J 2/17526; B41J 2/1753
See application file for complete search history.

(56) References Cited

U.S. PATENT DOCUMENTS

| | | | | |
|---|---|---|---|---|
| 6,862,652 | B1 * | 3/2005 | Tsuji | 347/19 |
| 7,562,958 | B2 | 7/2009 | Asauchi | |
| 8,075,115 | B2 * | 12/2011 | Ishizawa et al. | 347/86 |
| 2002/0164169 | A1 * | 11/2002 | Arai et al. | 399/12 |
| 2003/0011654 | A1 * | 1/2003 | Asauchi | 347/19 |
| 2008/0259135 | A1 * | 10/2008 | Asauchi et al. | 347/84 |
| 2009/0085939 | A1 * | 4/2009 | Asauchi | 347/6 |
| 2009/0085942 | A1 | 4/2009 | Asauchi | |
| 2012/0056920 | A1 | 3/2012 | Asauchi | |

FOREIGN PATENT DOCUMENTS

| | | |
|---|---|---|
| JP | 2007-196664 | 8/2007 |
| JP | 2009-083360 | 4/2009 |

* cited by examiner

*Primary Examiner* — Shelby Fidler

(57) ABSTRACT

A printing device includes a printing material container, a controller and a voltage applying unit. The printing material container has a storage device, a plurality of terminals for the storage device, and first and second attachment detection terminals. The storage device stores information of the amount of a printing material. The controller is connected to the plurality of terminals for the storage device and controls reading or writing of data from or in the storage device. The voltage applying unit applies a voltage for detection of attachment to the first attachment detection terminal. When the voltage applying unit applies the voltage for the detection of the attachment to the first attachment detection terminal, the controller sets the terminals for the storage device to a high impedance state.

8 Claims, 10 Drawing Sheets

PRINTING DEVICE

BACKGROUND

1. Technical Field

The present invention relates to a printing device and the like.

2. Related Art

For a printing device that has a detecting circuit that detects the type of a printing material container (ink cartridge or the like) and the amount of a printing material contained in the printing material container, a technique for preventing or suppressing failure, which is caused by a short circuit between a high voltage circuit to be used for detection and a storage device included in the printing material container or another circuit included in the printing device, of the printing material container and the printing device is described in JP-A-2007-196664, for example.

SUMMARY

An advantage of some aspects of the invention is that it provides a printing device that is capable of reliably and safely detecting attachment of a printing material container using a high voltage.

According to an aspect of the invention, a printing device includes: a printing material container that includes a storage device for storing information of a printing material, a plurality of terminals for the storage device, a first attachment detection terminal and a second attachment detection terminal; a controller that is connected to the plurality of terminals for the storage device and controls reading or writing of data from or in the storage device; and a voltage applying unit that applies a voltage for detection of attachment to the first attachment detection terminal. When the voltage applying unit applies the voltage for the detection of the attachment to the first attachment detection terminal, the controller sets the plurality of terminals for the storage device to a high impedance state.

According to the aspect of the invention, during the detection of an attached or unattached state of the printing material container, the plurality of terminals for the storage device are set to the high impedance state. Thus, even if any of the terminals for the storage device and the first attachment detection terminal to which the voltage for the detection of the attachment is applied are short-circuited, it is possible to prevent the voltage for the detection of the attachment from being applied to the storage device. As a result, it is possible to reliably and safely detect the attachment of the printing material container and reliably protect the storage device from a short circuit.

According to the aspect of the invention, before accessing the storage device, the controller may set the plurality of terminals for the storage device from the high impedance state to a certain voltage level.

According to the above, potentials of the plurality of terminals for the storage device can be set to be equal to each other, for example, to a ground potential.

According to the aspect of the invention, after the plurality of terminals for the storage device are set to the certain voltage level, the controller may read or write the data from or in the storage device by setting the plurality of terminals for the storage device from the certain voltage level to a predetermined voltage level.

According to the above, after the potentials of the plurality of terminals for the storage device are set to be equal to each other, for example, to the ground potential, the controller can write or read the data in or from the storage device. Thus, the storage device can operate in a stable manner.

According to the aspect of the invention, before the controller reads or writes the data from or in the storage device, the voltage applying unit may stop the application of the voltage for the detection of the attachment.

According to the above, the voltage for the detection of the attachment is not applied to the first and second attachment detection terminals during the reading or writing of the data from or in the storage device. Thus, it is possible to suppress the occurrence of noise caused by the voltage for the detection of the attachment. As a result, it is possible to reduce communication errors caused by the noise and memory errors caused by the noise.

According to the aspect of the invention, after completing the reading or writing of the data from or in the storage device, the controller may set the plurality of terminals for the storage device to the certain voltage level. After the plurality of terminals for the storage device are set to the certain voltage level, the voltage applying unit may apply the voltage for the detection of the attachment to the first attachment detection terminal, and the controller may set the plurality of terminals for the storage device to the high impedance state.

According to the above, after the reading or writing of the data from or in the storage device, the detection of the attachment can be performed. Thus, it is possible to determine whether or not the storage device has been normally accessed.

The printing device according to the aspect may further include a short circuit detector. The printing material container may further include a first short circuit detection terminal and a second short circuit detection terminal, and the short circuit detector may be connected directly to the first and second short circuit detection terminals or connected through a circuit element to the first and second short circuit detection terminals and detect a short circuit between at least one of the first and second short circuit detection terminals and at least one of the first and second attachment detection terminals.

According to the above, if the first short circuit detection terminal and the first attachment detection terminal are short-circuited, it is possible to detect the short circuit by causing a current occurred due to the short circuit to flow into the short circuit detector.

The printing device according to the aspect may further include an attachment detector. The printing material container may further include a resistor element for the detection of the attachment between the first and second attachment detection terminals. The attachment detector may detect the attachment of the printing material container on the basis of the voltage for the detection of the attachment and a current flowing in the resistor element.

According to the above, values of a current that flows into the attachment detector correspond to attached and unattached states of the printing material container and are different from each other. The attachment detector determines the attached or unattached state by detecting the difference between the current values.

According to the aspect of the invention, the voltage for the detection of the attachment may be higher than a high-potential-side power supply voltage that is supplied to the storage device.

According to the above, a value of the current that flows into the attachment detector is increased by increasing the voltage for the detection of the attachment. Thus, the accuracy of the detection can be improved.

According to the aspect of the invention, the printing material container may have a circuit board on which the plurality of terminals for the storage device, the first and second attachment detection terminals, and the first and second short circuit detection terminals are mounted, and the plurality of terminals for the storage device may be arranged in a region that is located on a surface of the circuit board and surrounded by the first and second attachment detection terminals and the first and second short circuit detection terminals.

According to the above, if the printing material adheres to the surface of the circuit board, it is possible to detect a short circuit occurred between the first or second attachment detection terminal and at least one of the terminals for the storage device. It is, therefore, possible to detect an abnormality of the printing material container.

BRIEF DESCRIPTION OF THE DRAWINGS

The invention will be described with reference to the accompanying drawings, wherein like numbers reference like elements.

DESCRIPTION OF EXEMPLARY EMBODIMENT

Hereinafter, an embodiment of the invention is described in detail. The embodiment described below does not unduly limit the contents of the invention described in Claims. Configurations described in the embodiment are not all essential as solving means of the invention.

1. Printing Device

Figure 1:
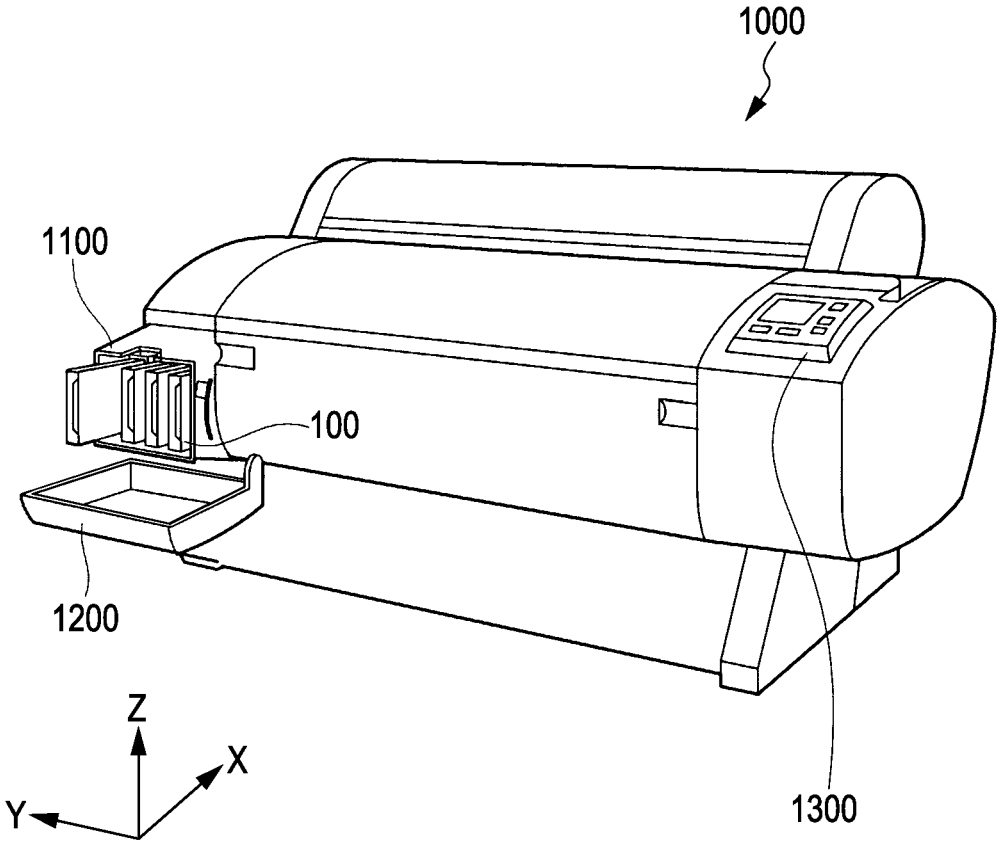
FIG. 1 is a perspective view of an example of the configuration of a printing device.

FIG. 1 is a perspective view of an example of the configuration of a printing device according to the embodiment. A printing device 1000 includes a cartridge attachment section 1100, a cover 1200 and an operating section 1300. An ink cartridge (printing material container) is attached to the cartridge attachment section 1100. The cover 1200 is capable of rotating. The cartridge attachment section 1100 is also referred to as a "cartridge holder" or a "holder". In the example illustrated in FIG. 1, four ink cartridges can be independently attached to the cartridge attachment section 1100. For example, four ink cartridges (printing material containers) 100 of black, yellow, magenta and cyan are attached to the cartridge attachment section 1100. The cover 1200 may be omitted. The operating section 1300 is an input device that is used for a user to enter various instructions and setting information. The operating section 1300 has a display unit that informs the user of various notifications.

Figure 2B:
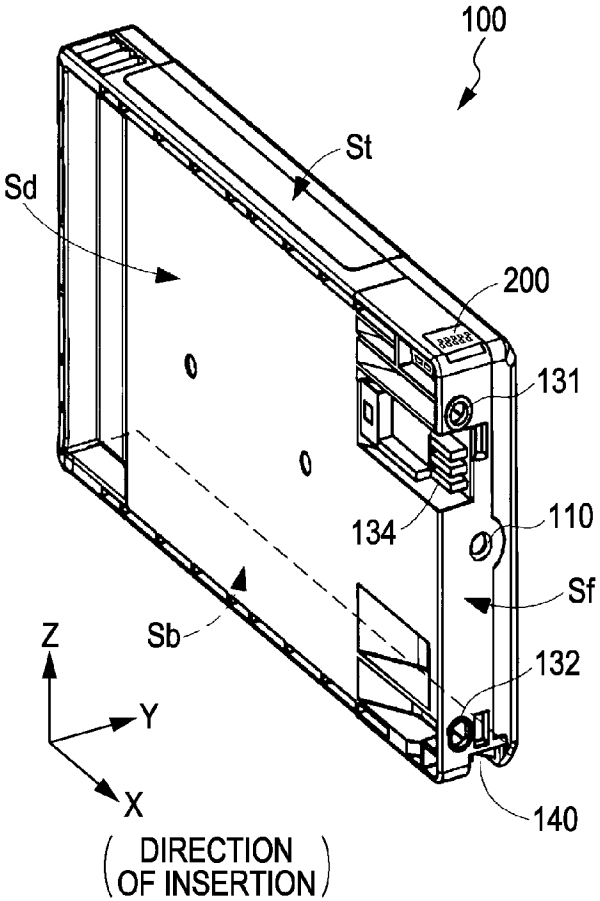
FIGS. 2A and 2B are perspective views of appearances of a printing material container.
Figure 2A:
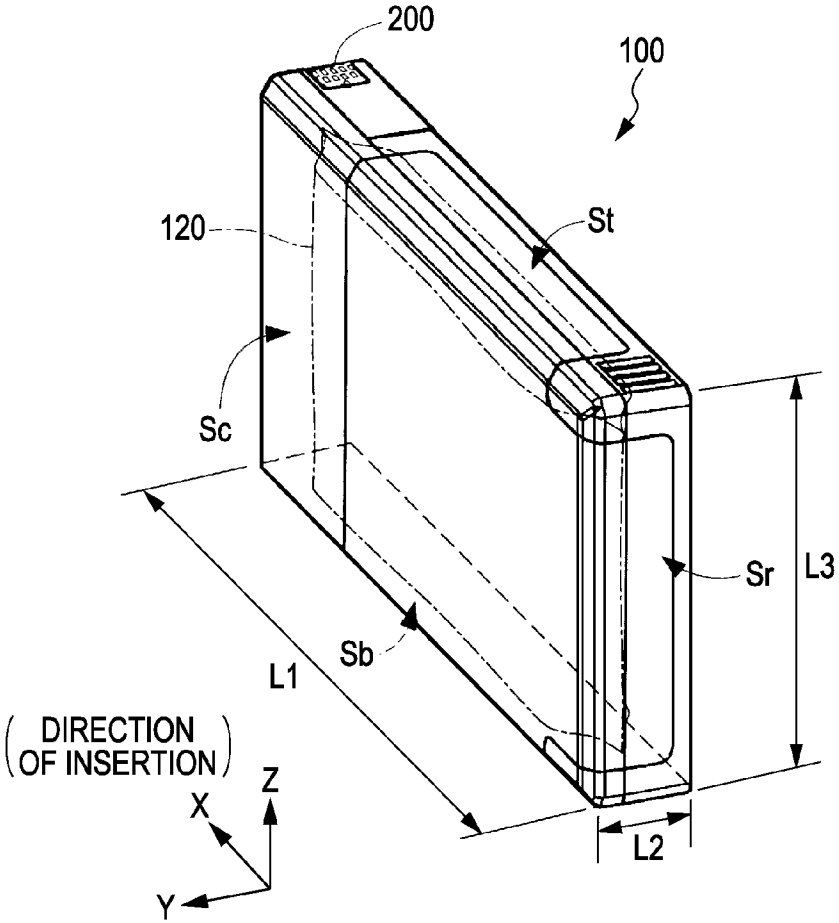

FIGS. 2A and 2B are perspective views of appearances of the printing material container (ink cartridge) 100. X, Y and Z axes illustrated in FIGS. 2A and 2B correspond to X, Y and Z axes illustrated in FIG. 1. The ink cartridge is hereinafter also referred to as a "cartridge". The cartridge 100 is formed in a flat and substantially rectangular parallelepiped shape. The cartridge 100 has a length L1, a width L2 and a height L3 in three directions. The length L1 (size in a direction in which the cartridge 100 is inserted into the printing device 1000) is largest. The width L2 is smallest. The height L3 is larger than the width L2 and smaller than the length L1.

The cartridge 100 has a front surface (first surface) Sf, a back surface (second surface) Sr, a top surface (third surface) St, a bottom surface (fourth surface) Sb and first and second side surfaces (fifth and sixth surfaces) Sc and Sd. The cartridge 100 has therein an ink storage chamber 120 (also referred to as "ink storage bag") made of a flexible material. The front surface Sf has two positioning holes 131 and 132 and an ink supply port 110. A circuit board 200 is arranged on the top surface St. A nonvolatile storage device 203 for storing information on ink is mounted on the circuit board 200. The first and second side surfaces Sc and Sd are opposite surfaces and are perpendicular to the front surface Sf, the top surface St, the back surface Sr and the bottom surface Sb. The cartridge 100 has a projections-and-depressions engagement section 134 arranged at a position where the second side surface Sd and the front surface Sf intersect each other.

Figure 3A:
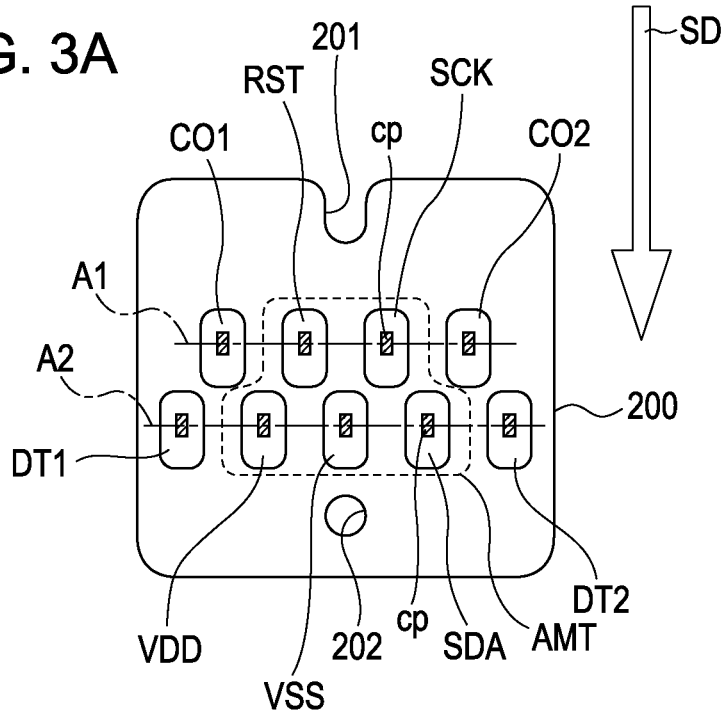
FIGS. 3A and 3B are diagrams illustrating an example of the configuration of a circuit board.
Figure 3B:
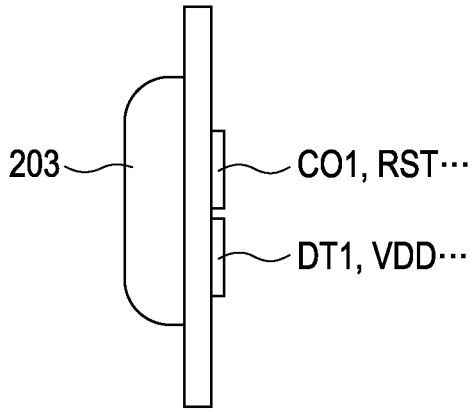

FIG. 3A illustrates an example of the configuration of the circuit board 200 according to the embodiment. A surface of the circuit board 200 is exposed to the outer side of the cartridge 100 when it is attached to the cartridge 100. FIG. 3B is a diagram illustrating the circuit board 200 when it is viewed from a side surface thereof. The circuit board 200 has a boss groove 201 at an upper end portion thereof and a boss hole 202 at a lower end portion thereof.

An arrow SD illustrated in FIG. 3A indicates a direction in which the cartridge 100 is attached to the cartridge attachment section 1100. The direction SD matches a direction (X direction) in which the cartridge 100 illustrated in FIGS. 2A and 2B is attached to the cartridge attachment section 1100. The circuit board 200 has the storage device 203 mounted on the back surface thereof. The circuit board 200 has a terminal group of nine terminals mounted on the front surface thereof. The storage device 203 stores information on the cartridge 100 and the information (for example, information on the amount of the ink, a remaining amount of the ink, the amount of consumed ink) on the ink contained in the cartridge 100. The terminals are each formed in a substantially rectangular shape. The terminals are arranged in two rows that are substantially perpendicular to the direction SD.

The circuit board 200 has a plurality of terminals RST, SCK, SDA, VDD and VSS for the storage device 203. The circuit board 200 also has a first attachment detection terminal DT1, a second attachment detection terminal DT2, a first short circuit detection terminal CO1 and a second short circuit detection terminal CO2.

Among the two rows, a row (located on the upper side in FIG. 3A) that is located in the rear in the direction SD is referred to as an upper row A1 or first row and the other row (located on the lower side in FIG. 3A) that is located in the front in the direction SD is referred to as a lower row A2 or second row. It can be considered that the rows A1 and A2 are rows formed by contact portions cp of the terminals.

The terminals CO1, RST, SCK and CO2 forming the upper row A1 and the terminals DT1, VDD, VSS, SDA and DT2 forming the lower row A2 have the following functions (or are used for the purposes described below).

Upper Row A1

(1) First short circuit detection terminal CO1

(2) Reset terminal RST (3) Clock terminal SCK (4) Second short circuit detection terminal CO2

Lower Row A2

(5) First attachment detection terminal DT1

(6) Power supply terminal VDD (7) Ground terminal VSS (8) Data terminal SDA (9) Second attachment detection terminal DT2

The first and second attachment detection terminals DT1 and DT2 are used to detect whether or not the ink cartridge 100 has been properly attached to the cartridge attachment section 1100, as described later. The first and second short circuit detection terminals CO1 and CO2 are used to detect short circuits that have occurred between the first and second short circuit detection terminals CO1 and CO2 and the first and second attachment detection terminals DT1 and DT2. The remaining five terminals RST, SCK, VDD, VSS and SDA are terminals for the storage device 203 and are also referred to as "memory terminals".

As illustrated in FIG. 3A, the plurality of terminals (memory terminals) RST, SCK, VDD, VSS and SDA for the storage device 203 are arranged in a region AMT that is located on a surface of the circuit board 203 and surrounded by the first and second attachment detection terminals DT1 and DT2 and the first and second short circuit detection terminals CO1 and CO2.

The terminals have the contact portions cp at central portions thereof. The contact portions cp of the terminals are in contact with corresponding terminals in the printing device 1000. The contact portions cp of the terminals that form the upper row A1 and the contact portions cp of the terminals that form the lower row A2 are alternately arranged in a staggered manner. The terminals that form the upper row A1, and the terminals that form the lower row A2, are alternately arranged in a staggered manner so that positions of the centers of the terminals that form the upper row A1 do not correspond with positions of the centers of the terminals that form the lower row A2 in the direction SD.

The contact portions cp of the first and second short circuit detection terminals CO1 and CO2 of the upper row A1 are arranged at both ends of the upper row A1 or arranged on the outermost sides of the upper row A1. The contact portions cp of the first and second attachment detection terminals DT1 and DT2 of the lower row A2 are arranged at both ends of the lower row A2 or arranged on the outermost sides of the lower row A2. The contact portions cp of the memory terminals RST, SCK, VDD, VSS and SDA are arranged in a substantially central part of a region in which the nine terminals are arranged. The contact portions cp of the first and second short circuit detection terminals CO1 and CO2 and the contact portions cp of the first and second attachment detection terminals DT1 and DT2 are arranged at four corners of a region in which the memory terminals RST, SCK, VDD, VSS and SDA are arranged.

Figure 4:
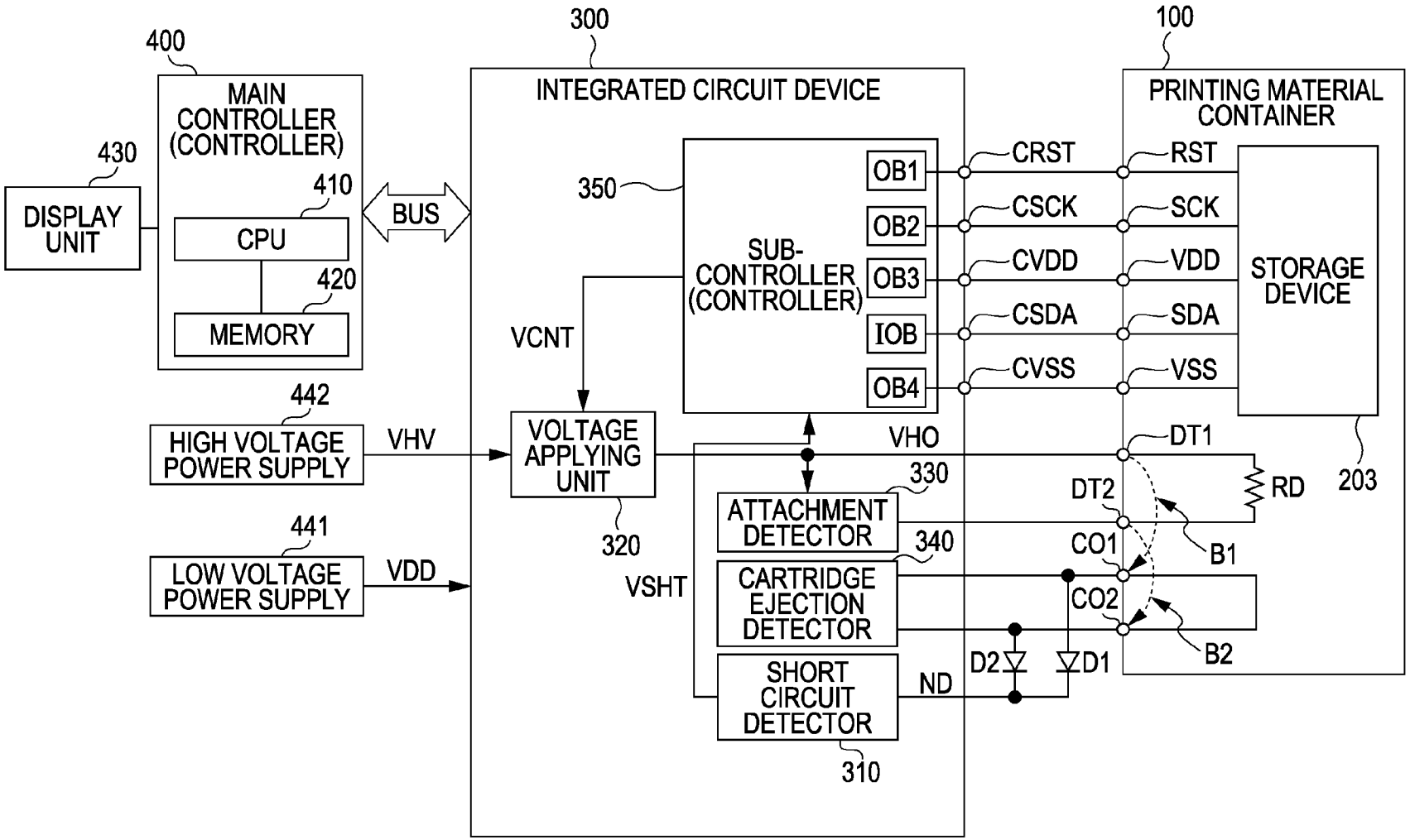
FIG. 4 is a diagram illustrating an example of a basic electrical configuration of the printing device.

FIG. 4 illustrates an example of a basic electrical configuration of the printing device 1000 according to the embodiment. The printing device 1000 according to the embodiment includes the ink cartridge 100, an integrated circuit device 300, a main controller 400 (or a controller in a broad sense), a low voltage power supply 441, a high voltage power supply 442 and a display unit 430. The integrated circuit device 300 includes a short circuit detector 310, a voltage application controller 320, an attachment detector 330, a cartridge ejection detector 340 and a sub-controller 350 (or the controller in a broad sense). The configuration of the printing device 1000 according to the embodiment is not limited to the configuration illustrated in FIG. 4 and may be variously modified. Some of the constituent elements of the printing device 1000 may be omitted or replaced with other constituent elements. Other constituent elements may be added to the printing device 1000.

The main controller 400 includes a CPU 410 and a memory 420 and controls a printing process. The main controller 400 performs communication with the integrated circuit device 300 through a bus BUS. In the example of the configuration illustrated in FIG. 4, the controller is divided into the main controller 400 and the sub-controller 350. The main controller 400 and the sub-controller 350 may be configured as the single controller.

The display unit 430 informs the user of various pieces of information such as an operational state of the printing device 1000 and an attached or unattached state of the cartridge. The display unit 430 is included in the operating section 1300 illustrated in FIG. 1, for example.

The low voltage power supply 441 generates a low power supply voltage (first power supply voltage) VDD. The first power supply voltage VDD is a normal power supply voltage (rated voltage of 3.3 V) to be used for a logic circuit. The high voltage power supply 442 generates a high power supply voltage (second power supply voltage) VHV. The second power supply voltage VHV is a high voltage (for example, a rated voltage of 42 V) to be used to drive a print head and eject ink. The second power supply voltage VHV is also used to generate a voltage VHO that is applied to the first attachment detection terminal DT1 and used for detection of attachment of the cartridge. The voltages VDD and VHV are supplied to the integrated circuit device 300. The voltages VDD and VHV are supplied to other circuits when necessary. Specifically, the high power supply voltage VHV is supplied from the high voltage power supply 442 to the voltage applying unit 320 of the integrated circuit device 300. The voltage VHO is output from the voltage applying unit 320 and supplied to the first attachment detection terminal DT1 of the printing material container 100 and the attachment detector 330. The voltage VHO for the detection of the attachment is higher than a high-potential-side power supply voltage (of, for example, 3.3 V) that is supplied to the storage device 203.

Among the nine terminals mounted on the circuit board 200 (illustrated in FIGS. 3A and 3B) of the cartridge 100, the reset terminal RST, the clock terminal SCK, the power supply terminal VDD, the data terminal SDA and the ground terminal VSS are electrically connected to the storage device 203. The storage device 203 does not have an address terminal and is a nonvolatile memory, where a memory cell to be accessed is determined on the basis of the number of pulses of a clock signal input from the clock terminal SCK and command data input through the data terminal SDA. The storage device 203 is synchronized with the clock signal so as to receive data through the data terminal SDA or transmit data through the data terminal SDA. The clock terminal SCK is used to supply the clock signal from the sub-controller 350 to the storage device 203.

A power supply voltage (of, for example, 3.3 volts) that is used to drive the storage device 203 is supplied from the printing device 1000 to the power supply terminal VDD. A ground voltage (of 0 volts) is supplied from the printing device 1000 to the ground terminal VSS. The power supply voltage to be used to drive the storage device 203 is generated and supplied by the sub-controller 350 on the basis of the low voltage power supply 441.

The data terminal SDA is used to transmit and receive a data signal between the sub-controller 350 and the storage device 203. The reset terminal RST is used to supply a reset signal from the sub-controller 350 to the storage device 203.

The first and second attachment detection terminals DT1 and DT2 are used to detect whether or not the ink cartridge 100 is properly attached to the cartridge attachment section 1100. A resistor element RD for the detection of the attachment is arranged between the first attachment detection terminal DT1 and the second attachment detection terminal DT2. The attachment detector 330 detects the attachment of the ink cartridge 100 on the basis of the voltage VHO output from the voltage applying unit 320 and a current flowing in the resistor element RD for the detection of the attachment. Specifically, when the voltage VHO that is output from the voltage applying unit 320 is applied to the first attachment detection terminal DT1, the voltage is applied to the resistor element RD and a current flows in the resistor element RD. Then, the attachment detector 330 detects the current and thereby detects the attachment. A method for detecting the attachment is described later in detail.

The first and second short circuit detection terminals CO1 and CO2 are electrically connected to each other in the ink cartridge 100 (specifically, in the circuit board 200). The cartridge ejection detector 340 detects an electrical conduction between the first and second short circuit detection terminals CO1 and CO2 and thereby detects whether or not the first and second short circuit detection terminals CO1 and CO2 electrically contact with terminals of the cartridge attachment section 1100 corresponding to the first and second short circuit detection terminals CO1 and CO2 or whether or not the ink cartridge 100 has been properly attached to the cartridge attachment section 1100. The printing device 1000 according to the embodiment uses the first and second attachment detection terminals DT1 and DT2 and the attachment detector 330 and can thereby detect the attachment of the ink cartridge 100. Thus, the cartridge ejection detector 340 may be omitted. When the cartridge ejection detector 340 is omitted, or when the detection of the attachment or ejection of the ink cartridge 100 is performed without the cartridge ejection detector 340, the first and second short circuit detection terminals CO1 and CO2 might not be electrically connected to each other.

In the following description, the detection of the attachment of the ink cartridge 100 by the attachment detector 330 is referred to as the "detection of the attachment". The detection of the ejection of the ink cartridge 100 by the cartridge ejection detector 340 is referred to as the "detection of the ejection".

A diode D1 is arranged between the first short circuit detection terminal CO1 and a detection node ND, while a diode D2 is arranged between the second short circuit detection terminal CO2 and the detection node ND. When the detection of the ejection of the cartridge is not performed, the first and second short circuit detection terminals CO1 and CO2 may be connected to the detection node ND without the diodes D1 and D2 therebetween.

The short circuit detector 310 is connected directly to the first and second short circuit detection terminals CO1 and CO2 or connected through the diodes D1 and D2 (or a circuit element in a broad sense) to the first and second short circuit detection terminals CO1 and CO2. For example, the short circuit detector 310 compares a voltage of the detection node ND with a reference voltage and thereby detects, on the basis of the comparison, that a high voltage (abnormal voltage) that is not originally applied to the first and second short circuit detection terminals CO1 and CO2 is applied to at least one of the second short circuit detection terminals CO1 and CO2 due to a short circuit occurred between at least one of the first and second short circuit detection terminals CO1 and CO2 and at least one of the first and second attachment detection terminals DT1 and DT2. Specifically, when the voltage of the detection node ND is higher than the reference voltage, the short circuit detector 310 detects the short circuit. When detecting the short circuit, the short circuit detector 310 outputs a short circuit detection signal VSHT to the sub-controller 350. The sub-controller 350 outputs a control signal VCNT to the voltage applying unit 320 on the basis of the short circuit detection signal VSHT. The voltage applying unit 320 stops the supply of the voltage VHO on the basis of the control signal VCNT output from the sub-controller 350.

When the aforementioned short circuit occurs, the reference voltage is set to a value that does not cause the storage device 203 (or a circuit such as the cartridge ejection detector 340) to be broken. Thus, the short circuit detector 310 can detect the short circuit before the voltage of the detection node ND reaches a value that causes a circuit such as the storage device 203 to be broken.

The sub-controller 350 includes output circuits OB1 to OB4 and an input/output circuit IOB. The output circuits OB1 to OB4 output signals or voltages to the reset terminal CRST, the clock terminal CSCK, the power supply terminal CVDD and the ground terminal CVSS, respectively. The input/output circuit IOB is connected to the data terminal CSDA and receives and outputs a data signal through the data terminal CSDA. The reset terminal CRST, the clock terminal CSCK, the power supply terminal CVDD, the ground terminal CVSS and the data terminal CSDA are connected to the reset terminal RST, the clock terminal SCK, the power supply terminal VDD, the ground terminal VSS and the data terminal SDA, respectively. The terminals RST, SCK, VDD, VSS, VSS and SDA are included in the printing material container 100. Detailed configurations of the output circuits OB1 to OB4 and the input/output circuit IOB are described later.

The sub-controller 350 is connected to the plurality of terminals (memory terminals) RST, SCK, VDD, VSS and SDA for the storage device 203. The sub-controller 350 and the main controller 400 control writing or reading of data in or from the storage device 203. For example, when the main controller 400 controls writing or reading of data in or from the storage device 203, the sub-controller 350 relays the data that is to be written or has been read. The sub-controller 350 performs control that is necessary to detect attachment or ejection of the cartridge, detect a short circuit, block the supply of the high voltage, and the like. The sub-controller 350 outputs, to the voltage applying unit 320 on the basis of the short circuit detection signal VSHT, the control signal VCNT that is used to stop the supply of the voltage VHO for detection of the attachment. The sub-controller 350 can be achieved by the logic circuit that includes a CMOS transistor, for example.

The main controller 400 and the sub-controller 350 may be configured as the single controller. When the main controller 400 and the sub-controller 350 are configured as the single controller, the single controller performs the control that is performed by the main controller 400 and the sub-controller 350.

As illustrated in FIG. 3A, the first short circuit detection terminal CO1 and the first attachment detection terminal DT1 are adjacent to each other, while the second short circuit detection terminal CO2 and the second attachment detection terminal DT2 are adjacent to each other. If conductive ink or the like adheres to the terminals on the circuit board 200, the adjacent two terminals CO1 and DT1 or the adjacent two terminals CO2 and DT2 may be short-circuited to cause current leakage due to the conductive ink or the like. In addition, the first attachment detection terminal DT1 and the power supply terminal VDD may be short-circuited or the second attachment detection terminal DT2 and the data terminal SDA may be short-circuited.

As described above, when the attachment detector 330 detects the attachment, the voltage VHO is applied to the first attachment detection terminal DT1. Thus, if at least one of the first and second attachment detection terminals DT1 and DT2 and at least one of the first and second short circuit detection terminals CO1 and CO2 are short-circuited to cause current leakage, there is a possibility that a high voltage may be applied to the cartridge ejection detector 340 during the detection of the attachment. If at least one of the first and second attachment detection terminals DT1 and DT2 and one of the power supply terminal VDD and the data terminal SDA are short-circuited, there is a possibility that a high voltage may be applied to the storage device 203.

In the printing device 1000 according to the embodiment, when the short circuit detector 310 has performed detection of a short circuit between terminals and the short circuit is detected, the voltage applying unit 320 can stop the supply of the voltage VHO.

Specifically, if the first attachment detection terminal DT1 and the first short circuit detection terminal CO1 are short-circuited as indicated by B1 of FIG. 4, current flows from the first attachment detection terminal DT1 to the first short circuit detection terminal CO1. Then, the forward current flows from the first short circuit detection terminal CO1 to the detection node ND through the diode D1. As a result, a potential of the detection node ND increases. If the second attachment detection terminal DT2 and the second short circuit detection terminal CO2 are short-circuited as indicated by B2 of FIG. 4, current flows from the second attachment detection terminal DT2 to the second short circuit detection terminal CO2. Then, the forward current flows from the second short circuit detection terminal CO2 to the detection node ND through the diode D2. As a result, the potential of the detection node ND increases. The short circuit detector 310 compares the voltage of the detection node ND with the reference voltage and thereby detects the short circuit.

In the printing device 1000 according to the embodiment, when the voltage applying unit 320 applies the voltage VHO to the first attachment detection terminal DT1, the sub-controller 350 sets the terminals (memory terminals) RST, SCK, VDD, VSS and SDA for the storage device 203 to a high impedance state (floating state). Thus, if the first attachment detection terminal DT1 and the first short circuit detection terminal CO1 or the power supply terminal VDD are short-circuited, or if the second attachment detection terminal DT2 and the second short circuit detection terminal CO2 or the data terminal SDA are short-circuited, the short circuit detector 310 detects that an excessive voltage has been applied to the detection node ND before a high voltage is applied to the storage device 203 during the detection of the attachment. The sub-controller 350 stops the supply of the voltage VHO on the basis of the detection by the short circuit detector 310. This prevents a voltage that is equal to or higher than the maximum rated voltage of the storage device 203 from being applied to the storage device 203.

In order to read or write data from or in the storage device 203, the main controller 400 instructs the sub-controller 350 to set the terminals RST, SCK, VDD, VSS and SDA for the storage device 203 from the high impedance state to a ground level (GND level, VSS level, or certain voltage in a broad sense) before accessing the storage device 203. After the plurality of terminals RST, SCK, VDD, VSS and SDA for the storage device 203 are set to the ground level, the main controller 400 reads or writes the data from or in the storage device 203 through the sub-controller 350.

Specifically, after the plurality of terminals RST, SCK, VDD, VSS and SDA for the storage device 203 are set to the ground level, the sub-controller 350 controls voltages of the terminals RST, SCK, VDD, VSS and SDA so as to change the voltages of the terminals RST, SCK, VDD, VSS and SDA from the ground level to a predetermined level, and the main controller 400 reads or writes the data from or in the storage device 203. Thus, before the main controller 400 reads or writes the data from or in the storage device 203, potentials of all the memory terminals can be set to be equal to each other. The storage device 203, therefore, can operate in a stable manner. The predetermined level is a voltage that is applied to each of the terminals for the storage device 203 in order to read or write the data.

The setting of the terminals RST, SCK, VDD, VSS and SDA for the storage device 203 to the high impedance state or the certain voltage is performed by the sub-controller 350. Specifically, when the output circuits OB1 to OB4 and the input/output circuit IOB set the terminals CRST, CSCK, CVDD, CVSS and CSDA to the high impedance state or the certain level, the terminals RST, SCK, VDD, VSS and SDA are set to the high impedance state or the certain level. The certain level is the ground level (GND level of 0 V), for example. The certain level, however, may be another level.

Before the sub-controller 350 reads or writes data from or in the storage device 203, the voltage applying unit 320 stops the application of the voltage VHO for the detection of the attachment. Thus, the voltage VHO for the detection of the attachment is not applied to the first and second attachment detection terminals DT1 and DT2 during the reading or writing of the data from or in the storage device 203. It is, therefore, possible to suppress the occurrence of noise caused by the voltage VHO. As a result, it is possible to reduce communication errors caused by the noise and memory errors caused by the noise.

After the sub-controller 350 completes the reading or writing of the data from or in the storage device 203, the voltages of the plurality of terminals for the storage device 203 are set to the ground level (certain level in a broad sense). After the voltages of the plurality of terminals for the storage device 203 are set to the ground level, the voltage applying unit 320 applies the voltage VHO for the detection of the attachment to the first attachment detection terminal DT1, and the plurality of terminals for the storage device 203 are set to the high impedance state. Thus, the detection of the attachment can be performed during the time when reading and writing of data from or in the storage device 203 is not performed.

Even if terminals are short-circuited due to adherence of the printing material such as the ink or the like in the printing device 1000 according to the embodiment, the possibility that a high voltage may be applied to the storage device 203 during the detection of the attachment can be reduced. In addition, the potentials of the memory terminals can be equal to each other before access to the storage device 203, and it is possible to stop an application of a high voltage to the storage device 203 during access to the storage device 203. As a result, the detection of the attachment can be reliably and safely performed, and the storage device 203 can be reliably accessed.

Figure 5:
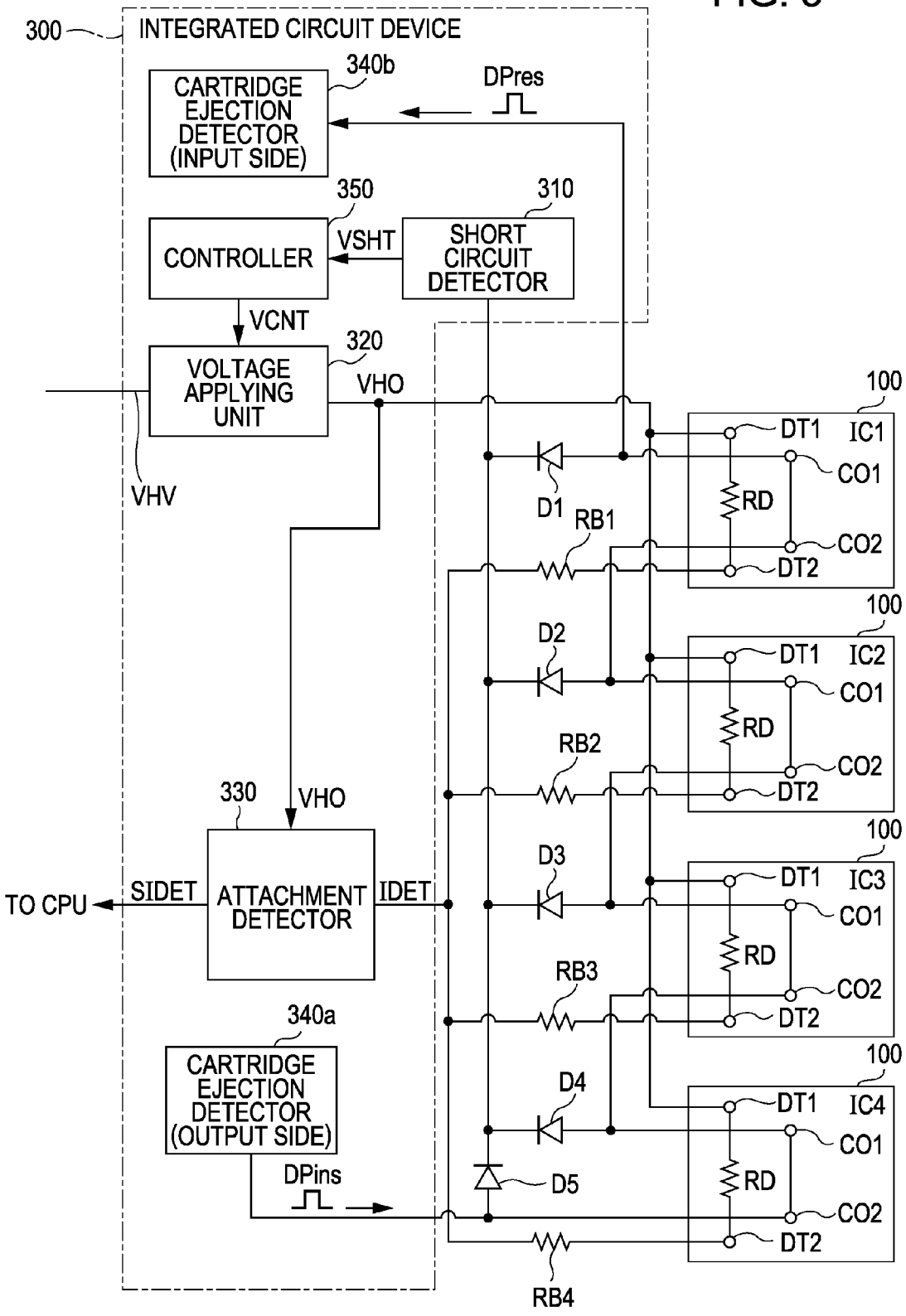
FIG. 5 is a diagram illustrating an example of a configuration in which a plurality of printing material containers are included in the printing device.

FIG. 5 illustrates an example in which a plurality of ink cartridges are included in the printing device 1000 according to the embodiment. In the example illustrated in FIG. 5, the printing device 1000 includes four ink cartridges (printing material containers) 100 (IC1 to IC4). The number of ink cartridges is not limited to four and may be two, three, or five or more.

The ink cartridges IC1 to IC4 each have the same configuration as the configuration illustrated in FIG. 4, and a detailed description thereof is omitted. The integrated circuit device 300 illustrated in FIG. 5 has the same configuration as the configuration illustrated in FIG. 4. In FIG. 5, however, the cartridge ejection detector 340 is divided into a cartridge ejection detector (output side) 340*a* and a cartridge ejection detector (input side) 340*b* for convenience of the illustration. The cartridge ejection detectors 340*a* and 340*b* can be achieved by an analog circuit or a logic circuit that includes a CMOS transistor, for example.

When the printing device 1000 includes the plurality of ink cartridges, the first and second short circuit detection terminals CO1 and CO2 of the ink cartridges (for example, ink cartridges IC1 to IC4) are connected to the detection node ND of the single short circuit detector 310 through a plurality of diodes (for example, D1 to D5). Specifically, the first short circuit detection terminal CO1 of the ink cartridge IC1 is connected to the detection node ND through the diode D1. The second short circuit detection terminal CO2 of the ink cartridge IC1 and the first short circuit detection terminal CO1 of the ink cartridge IC2 are connected to the detection node ND through the diode D2. The second short circuit detection terminal CO2 of the ink cartridge IC2 and the first short circuit detection terminal CO1 of the ink cartridge IC3 are connected to the detection node ND through the diode D3. Cathodes (negative electrodes) of the diodes are connected to the detection node ND. In this configuration, the short circuit detector 310 can detect a short circuit without affecting detection of ejection of the ink cartridges by the cartridge ejection detector 340.

A method for detecting the short circuit is similar to the method described with reference to FIG. 4. The short circuit detector 310 compares the voltage of the detection node ND with the reference voltage and thereby detects the short circuit. Specifically, when the voltage of the detection node ND is higher than the reference voltage, the short circuit detector 310 detects the short circuit. When the short circuit detector 310 has detected the short circuit, the sub-controller 350 causes the voltage applying unit 320 to stop the supply of the voltage VHO.

Resistor elements RB1 to RB4 are used to detect attachment of the ink cartridges IC1 to IC4 by the attachment detector 330 and have resistances that are different from each other. Thus, the attachment detector 330 can detect an ink cartridge among the ink cartridges IC1 to IC4 that is not attached to the cartridge attachment section 1100. A method for detecting the attachment is described later in detail.

The cartridge ejection detector 340 (340*a*, 340*b*) detects ejection of the ink cartridges in the following manner. When all the four ink cartridges are attached to the cartridge attachment section 1100, the first and second short circuit detection terminals CO1 and CO2 of the ink cartridges IC1 to IC4 are electrically connected to each other, as illustrated in FIG. 5. Thus, a signal DPins that is output from the cartridge ejection detector (output side) 340*a* is detected as a signal DPres by the cartridge ejection detector (input side) 340*b*. When any of the four ink cartridges IC1 to IC4 is not attached, the first and second short circuit detection terminals CO1 and CO2 of the ink cartridges IC1 to IC4 are not completely electrically connected to each other. In this case, the cartridge ejection detector (input side) 340*b* does not detect the signal DPres. In this manner, the cartridge ejection detector 340 can detect, on the basis of whether or not the cartridge ejection detector (input side) 340*b* detects the signal DPres, whether or not an ink cartridge among the ink cartridges IC1 to IC4 has been ejected.

Figure 6:
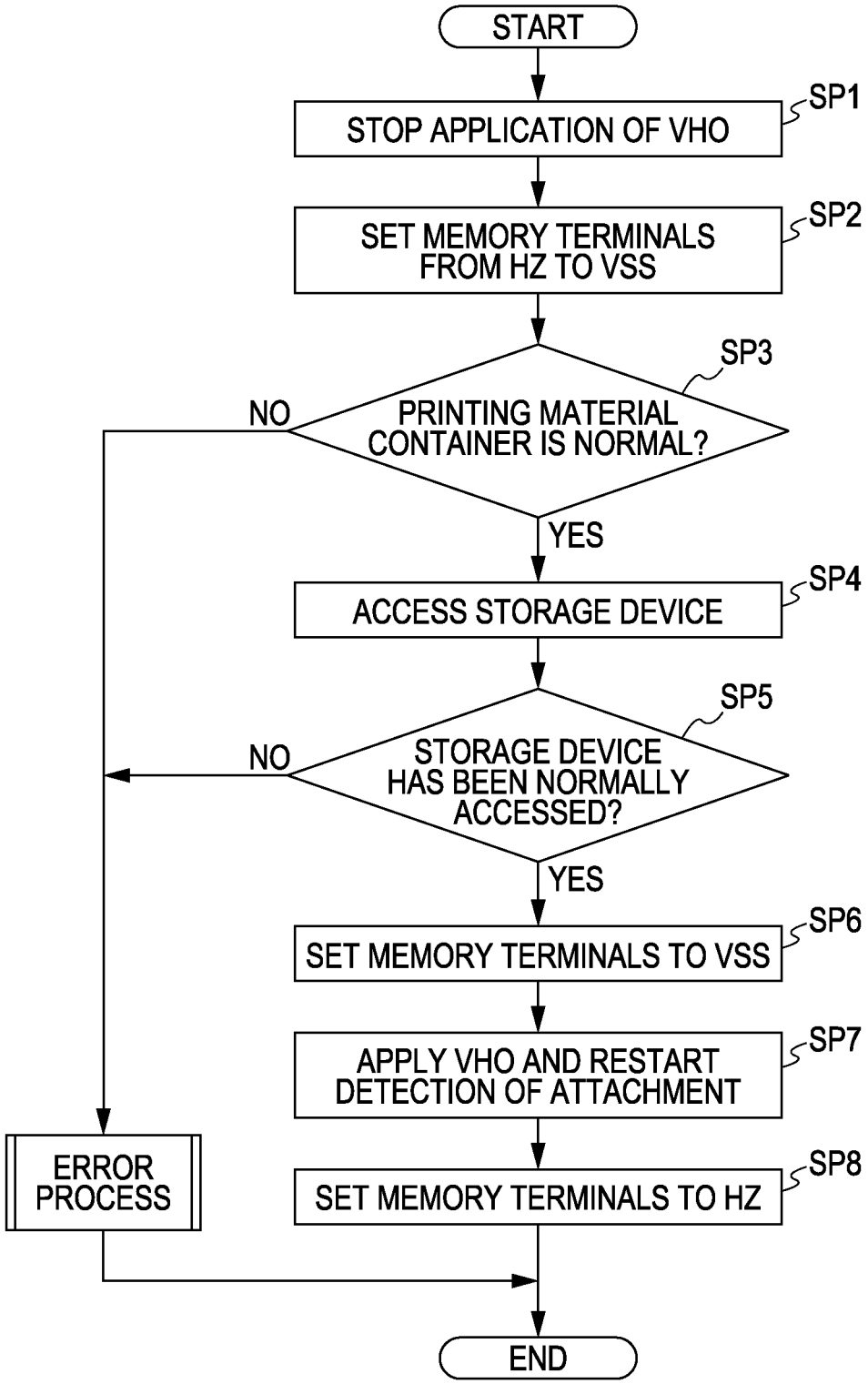
FIG. 6 is a flowchart of a process of detecting attachment of a printing material container and accessing a storage device.

FIG. 6 is a flowchart of a process of detecting attachment and accessing the storage device 203 in the printing device 1000 according to the embodiment. As described above, for the printing device 1000, ink information (for example, the amount of the ink contained in the ink cartridge 100 and used, information on manufacturing of the ink cartridge 100, and the like) is stored in the storage device 100 included in the ink cartridge 100. The ink information is written in the storage device 203 through the sub-controller 350 by the main controller 400 upon cleaning of a head, or when a predetermined amount of the ink contained in the ink cartridge is consumed by a printing operation, or when a power supply of the printing device 1000 is turned off. The ink information is read from the storage device 203 through the sub-controller 350 in accordance with a request provided by the main controller 400 when the power supply of the printing device 1000 is turned on. The process illustrated in FIG. 6 is performed by the main controller 400 and the sub-controller 350.

After the power supply of the printing device 1000 is turned on, the main controller 400 and the sub-controller 350 continue to maintain the memory terminals in the high impedance state except when the storage device 203 is accessed. In addition, the main controller 400 and the sub-controller 350 constantly or periodically perform the detection of attachment or ejection of the ink cartridge. The detection of the ejection of the ink cartridge is also performed during access to the storage device 203.

When intending to start accessing the storage device 203, the main controller 400 stops the detection of the attachment. Specifically, the main controller 400 stops the process of applying the voltage VHO and detecting attachment (in step SP1).

In step SP2, the sub-controller 350 sets the memory terminals from the high impedance state HZ to the GND level (ground level, VSS level). In this case, when the first or second short circuit detection terminal CO1 or CO2 and any of the memory terminals have been short-circuited, for example, when the first short circuit detection terminal CO1 and the terminal VDD have been short-circuited, or when the second short circuit detection terminal CO2 and the terminal SDA have been short-circuited, the cartridge ejection detector 340 can detect the short circuit.

In step SP3, the main controller 400 and the sub-controller 350 determine whether or not the printing material container 100 is normal. Specifically, the main controller 400 and the sub-controller 350 determine whether or not the printing material container 100 has been properly attached to the cartridge attachment section 1100 and whether or not terminals are short-circuited. When the printing material container 100 is normal, the process proceeds to step SP4. When the printing material container 100 is not normal, an error process is performed. The error process is a process of displaying an error message on the display unit 430, for example.

In step SP4, the storage device 203 is accessed. Specifically, the sub-controller 350 supplies signals and power supply voltages to the memory terminals and writes or reads data in or from the storage device 203.

In step SP5, the sub-controller 350 determines whether or not the storage device 203 has been normally accessed. Specifically, for the writing of the data, the sub-controller 350 transmits a write command and the data to be written to the storage device 203. After a certain time elapses after the transmission, the storage device 203 transmits to the sub-controller 350 a signal indicating completion of the writing. The sub-controller 350 receives the signal indicating the completion of the writing, and determines, on the basis of the reception of the signal, whether or not the access to the storage device 203 has been normally completed. For the reading of the data, the sub-controller 350 reads the data from the storage device 203. The data transmitted to the sub-controller 350 has a parity bit added thereto. The sub-controller 350 checks the parity bit and can thereby determine whether or not the data read from the storage device 203 is normal. When the storage device 203 has been normally accessed, the process proceeds to step SP6. When the storage device 203 has not been normally accessed, the error process is performed.

When the access to the storage device 203 is normally completed, the memory terminals are set to the GND level in step SP6. The cartridge ejection detector 340 can perform the detection of the ejection of the ink cartridge. In this case, when terminals (for example, the first short circuit detection terminal CO1 and the terminal VDD, or the second short circuit detection terminal CO2 and the terminal SDA) have been short-circuited, the cartridge ejection detector 340 can detect the short circuit.

In step SP7, the voltage VHO for the detection of the attachment is applied to the first and second attachment detection terminals DT1 and DT2, and whereby the detection of the attachment restarts.

In step SP8, the sub-controller 350 sets the memory terminals to the high impedance state HZ. In this case, when terminals (for example, the first attachment detection terminal DT1 and the first short circuit detection terminal CO1 or the second attachment detection terminal DT2 and the second short circuit detection terminal CO2) have been short-circuited, the short circuit detector 310 can detect the short circuit.

As illustrated in the flowchart of FIG. 6, when the power supply of the printing device 1000 is in the ON state, the printing device 1000 according to the embodiment constantly performs the detection of attachment and ejection of the ink cartridges and thereby detects whether or not all the ink cartridges have been properly attached. During access to the storage device 203, the application of the voltage VHO is stopped and whereby noise is reduced. Thus, the voltage VHO is not applied to the memory terminals even if at least one of the first and second attachment detection terminal DT1 and DT2 and at least one of the memory terminals are short-circuited.

When the storage device 203 is not accessed, the memory terminals are set to the high impedance state. If at least one of the first and second attachment detection terminals DT1 and DT2 and at least one of the first and second short circuit detection terminals CO1 and CO2 are short-circuited, at least one of the memory terminals and at least one of the first and second attachment detection terminals DT1 and DT2 may be short-circuited. Thus, the application of the voltage VHO is stopped, and whereby the possibility that the voltage VHO may be applied to the storage device 203 can be reduced.

As a result, highly reliable access to the storage device 203 can be achieved, while the detection of attachment is performed.

The printing device constantly performs the detection of attachment and ejection of the ink cartridges during replacement of an ink cartridge, although a detailed description thereof is omitted. During the replacement of the ink cartridge, any of the memory terminals of the ink cartridge may accidentally contact a terminal that is included in the printing device and through which the voltage VHO is supplied. Thus, the sub-controller 350 sets the memory terminals (RST, SCK, SDA, VDD and VSS) of the storage device 203 to the ground level in accordance with an instruction provided by the main controller 400 and thereby protects the storage device 203 from a high voltage during the detection of the attachment and ejection of the ink cartridges.

2. Examples of Detailed Configurations of Circuits

Figure 7A:
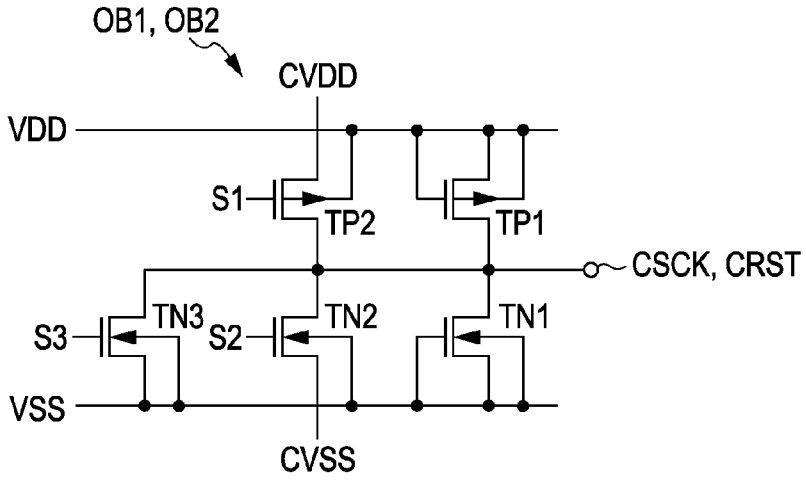
FIGS. 7A to 7D are diagrams illustrating examples of detailed configurations of output circuits and a detailed configuration of an input/output circuit.
Figure 7B:
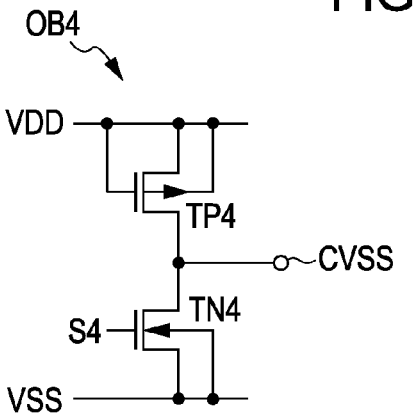
Figure 7C:
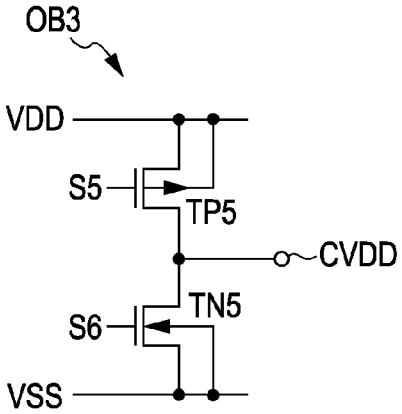
Figure 7D:
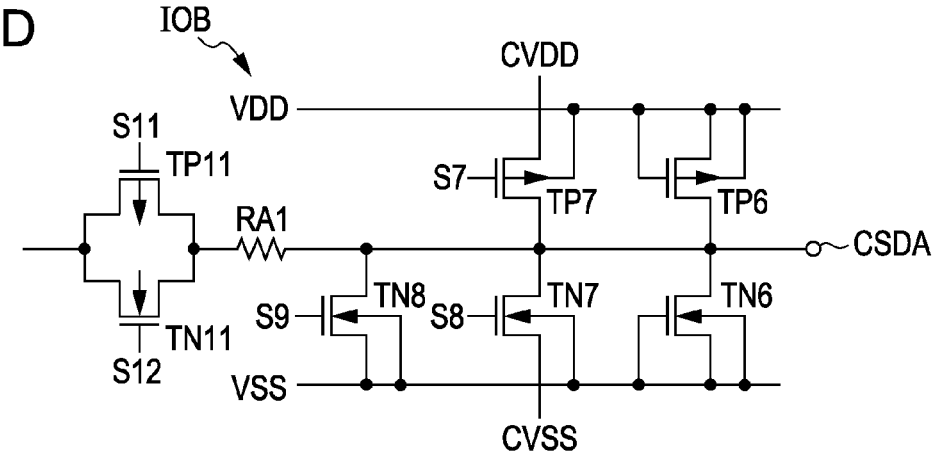

FIGS. 7A to 7D illustrate examples of detailed configurations of the output circuits OB1 to OB4 and a detailed configuration of the input/output circuit IOB. FIG. 7A illustrates an example of detailed configurations of the output circuits OB1 and OB2. FIG. 7B illustrates an example of a detailed configuration of the output circuit OB4. FIG. 7C illustrates an example of a detailed configuration of the output circuit OB3. FIG. 7D illustrates an example of a detailed configuration of the input/output circuit IOB. The configurations of the output circuits OB1 to OB4 according to the embodiment and the configuration of the input/output circuit IOB according to the embodiment are not limited to the configurations illustrated in FIGS. 7A to 7D and may be variously modified. Some of constituent elements of the output circuits OB1 to OB4 and constituent elements of the input/output circuit IOB may be omitted or replaced with other constituent elements. Other constituent elements may be added to the output circuits OB1 to OB4 and the input/output circuit IOB.

As illustrated in FIG. 7A, the output circuits OB1 and OB2 each include P-type transistors TP1 and TP2 and N-type transistors TN1, TN2 and TN3. The transistors TP1 and TN1 are used to prevent an element from being broken due to electrostatic discharge (ESD). The transistors TP2 and TN2 are controlled by control signals S1 and S2, respectively, and used to set the terminal CSCK to a high (H) level, a low (L) level or the high impedance state. Specifically, when the levels of the control signals S1 and S2 are a low (L) level, the terminal CSCK (CRST) is set to the H level. When the levels of the control signals S1 and S2 are a high (H) level, the terminal CSCK (CRST) is set to the L level. When the level of the control signal S1 is the H level and the level of the control signal S2 is the L level, the terminal CSCK (CRST) is set to the high impedance state. The transistor TN3 is controlled by a control signal S3. During a normal state, the level of the control signal S3 is a low (L) level. When an abnormality occurs, for example, when a high voltage is detected, the control signal S3 is set to the H level and the transistor TN3 operates as an amplification buffer that reduces the voltage of the terminal CSCK (CRST) to the L level.

As illustrated in FIG. 7B, the output circuit OB4 includes a P-type transistor TP4 and an N-type transistor TN4 that are controlled by a control signal S4. When the level of the control signal S4 is a high (H) level, the terminal CVSS is set to the VSS level (ground level). When the level of the control signal S4 is a low (L) level, the terminal CVSS is set to the high impedance state. The transistors TP4 and TN4 operate as electrostatic breakdown prevention elements.

As illustrated in FIG. 7C, the output circuit OB3 includes a P-type transistor TP5 and an N-type transistor TN5. The P-type transistor TP5 is controlled by a control signal S5. The N-type transistor TN5 is controlled by a control signal S6. When the levels of the control signals S5 and S6 are low (L) levels, the terminal CVDD is set to a VDD level. When the levels of the control signals S5 and S6 are high (H) levels, the terminal CVDD is set to the VSS level. When the level of the control signal S5 is the H level and the level of the control signal S6 is the L level, the terminal CVDD is set to the high impedance state. The transistors TP5 and TN5 operate as electrostatic breakdown prevention elements.

As illustrated in FIG. 7D, the input/output circuit IOB includes P-type transistors TP6, TP7 and TP11 and N-type transistors TN6, TN7, TN8 and TN11. The transistors TP6 and TN6 are electrostatic breakdown prevention elements. The transistors TP7 and TN7 are controlled by control signals S7 and S8, respectively. Specifically, when the levels of the control signals S7 and S8 are low (L) levels, the terminal CSDA are set to a high (H) level. When the levels of the control signals S7 and S8 are high (H) levels, the terminal CSDA are set to a low (L) level. When the level of the control signal S7 is the H level and the level of the control signal S8 is the L level, the terminal CSDA is set to the high impedance state. The transistors TP11 and TN11 form a transmission gate (analog switch) and are turned on and off by control signals S11 and S12, respectively. Specifically, when the terminal CSDA is used as an output terminal, the control signal S11 is set to a high (H) level, the control signal S12 is set to a low (L) level, and the transmission gate is turned off. On the other hand, when the terminal CSDA is used as an input terminal, the control signal S11 is set to the L level, the control signal S12 is set to the H level, and the transmission gate is turned on so that a data signal input to the terminal CSDA can pass through the transmission gate.

During the detection of attachment, the memory terminals RST, SCK, VDD, VSS and SDA are set to the high impedance state by the output circuits OB1 to OB4 illustrated in FIGS. 7A to 7C and the input/output circuit IOB illustrated in FIG. 7D. Before access to the storage device 203, the voltages of the memory terminals RST, SCK, VDD, VSS and SDA can be set to the VSS level (certain level in a broad sense). The control signals S1 to S9, S11 and S12 are generated by the sub-controller 350 in accordance with the flowchart (illustrated in FIG. 6) of the process of detecting attachment and accessing the storage device 203.

Figure 8:
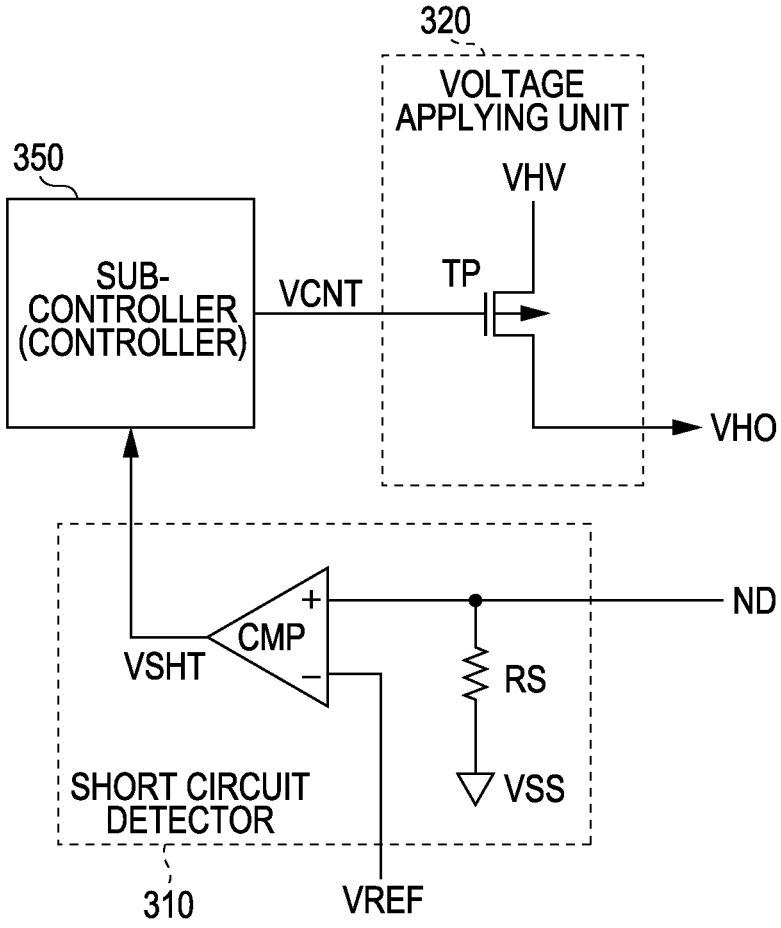
FIG. 8 is a diagram illustrating an example of a detailed configuration of a short circuit detector and a detailed configuration of a voltage applying unit.

FIG. 8 illustrates an example of a detailed configuration of the short circuit detector 310 and a detailed configuration of the voltage applying unit 320. The short circuit detector 310 includes a comparator CMP and a resistor element RS. The voltage applying unit 320 includes a P-type transistor TP. The short circuit detector 310 and the voltage applying unit 320 that are used in the embodiment are not limited to those having the configurations illustrated in FIG. 8. The short circuit detector 310 and the voltage applying unit 320 may be variously modified. Some of the constituent elements of the short circuit detector 310 and voltage applying unit 320 may be omitted or replaced with other constituent elements. Other constituent elements may be added to the short circuit detector 310 and the voltage applying unit 320.

As described above, if a short circuit has occurred and an abnormal voltage is applied to at least one of the short circuit detection terminals CO1 and CO2 due to the occurrence of the short circuit, a voltage that is higher than the ground voltage (low-potential-side power supply voltage) VSS (for example, 0 V) is applied to the detection node ND. The voltage of the detection node ND is applied to an input terminal (+) of the comparator CMP. A reference voltage VREF is applied to an input terminal (−) of the comparator CMP.

When the voltage of the input terminal (+) is lower than the reference voltage VREF, the comparator CMP outputs a voltage of a low (L) level (low potential level) as the short circuit detection signal VSHT. When the voltage of the input terminal (+) is higher than the reference voltage VREF, the comparator CMP outputs a voltage of a high (H) level (high potential level) as the short circuit detection signal VSHT. Thus, when a short circuit has occurred, the voltage of the detection node ND is higher than the reference voltage VREF, and the short circuit detection signal VSHT is set to the H level. The reference voltage is set to a voltage value that does not cause the storage device 203 or the like to be broken when the short circuit has occurred.

When the short circuit detector 310 detects a short circuit or when the level of the short circuit detection signal VSHT is changed from the L level to the H level, the sub-controller 350 changes the control signal VCNT from a low (L) level to a high (H) level.

A source of the P-type transistor TP is connected to a high voltage power supply node VHV. The control signal VCNT is input to a gate of the P-type transistor TP from the sub-controller 350. When the level of the control signal VCNT is the L level, the P-type transistor TP is in the ON state and the voltage VHO for the detection of the attachment is output from a drain of the P-type transistor TP. When the level of the control signal VCNT is the H level, or when a short circuit has been detected, the transistor TP is turned off so that the supply of the high voltage is blocked. Thus, when the short circuit detector 310 has detected a short circuit, the control signal VCNT to be output from the sub-controller 350 is set to the H level and the P-type transistor TP is turned off. As a result, the supply of the voltage VHO for the detection of the attachment is stopped.

When the supply of the voltage VHO for the detection of the attachment is stopped, the high voltage is not applied to the first attachment detection terminal DT1 of the ink cartridge 100. Thus, when the voltage of the detection node ND has been increased due to a short circuit occurred between the first attachment detection terminal DT1 and the first short circuit detection terminal CO1, the voltage of the detection node ND decreases to a low (L) level. In this case, the short circuit detection signal VSHT is changed to the L level again. The sub-controller 350, however, continues to maintain the control signal VCNT at the H level. Thus, when a short circuit has occurred between terminals, the short circuit detector 310 can detect the short circuit and the voltage applying unit 320 can stop the supply of the high voltage.

Figure 9A:
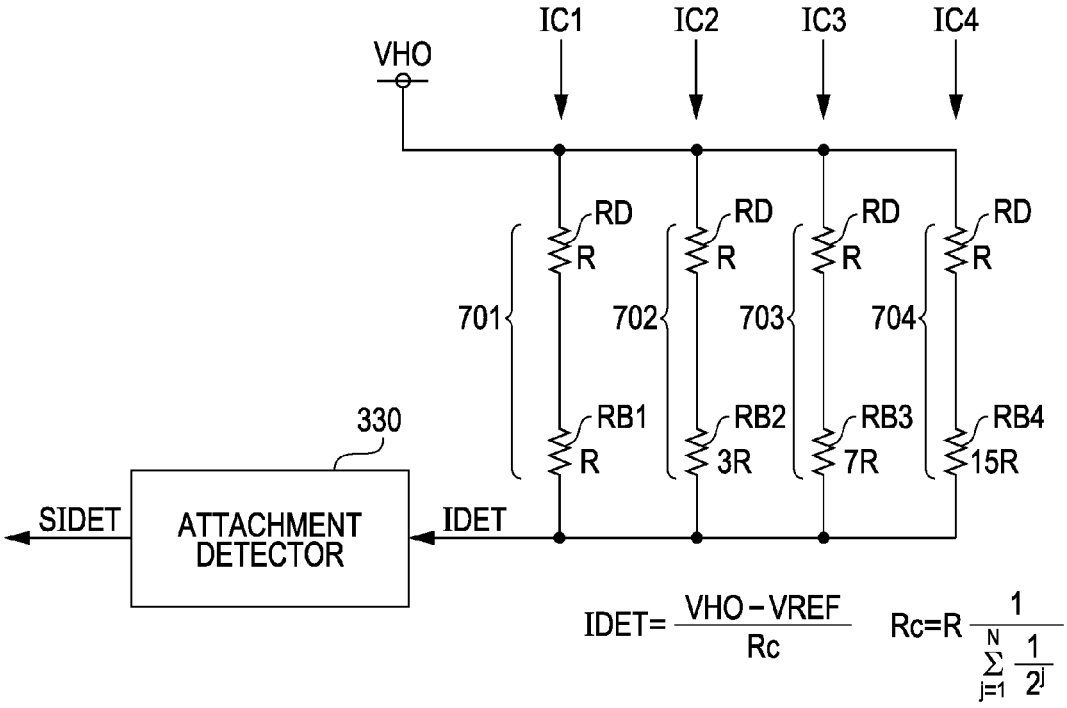
FIGS. 9A and 9B are diagrams describing a method for detecting attachment of cartridges.
Figure 9B:
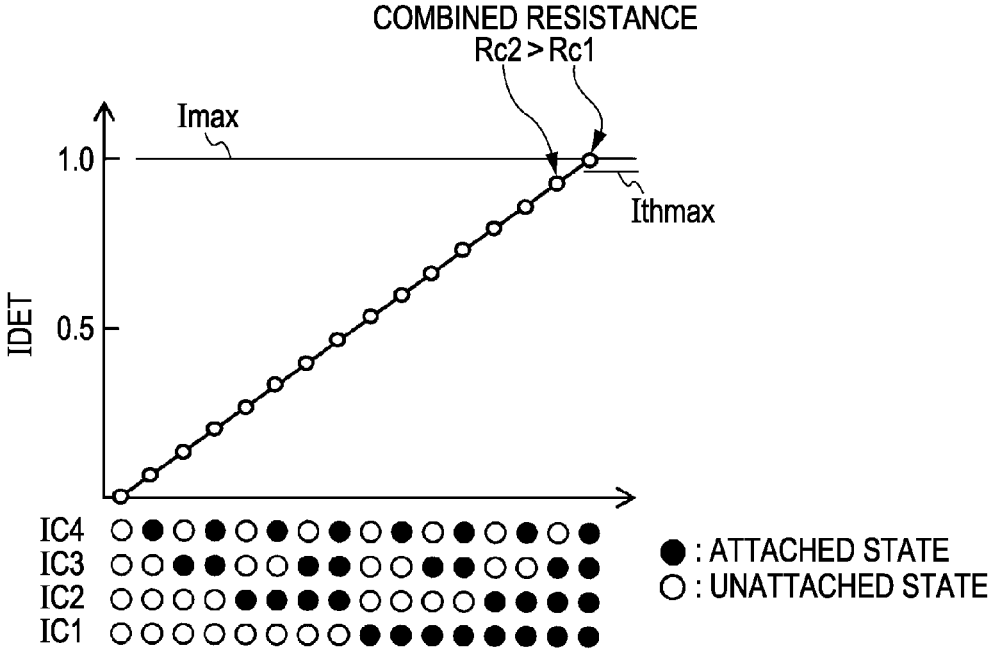

FIGS. 9A and 9B are diagrams describing a method for detecting attachment of the cartridges (printing material containers) to the printing device according to the embodiment. FIG. 9A illustrates the state in which all the cartridges IC1 to IC4 are attached to the cartridge attachment section 1100 of the printing device 1000. Resistances of resistor elements RD for detection of attachment of the four cartridges IC1 to IC4 are set to the same value R. Resistor elements RB1 to RB4 are connected in series to the resistor elements RD of the cartridges IC1 to IC4, respectively. Resistances of the resistor elements RB1 to RB4 are set to different values. Specifically, a resistance of a resistor element RBn that is among the resistor elements RB1 to RB4 and corresponds to an nth (n is in a range of 1 to 4) cartridge ICn is set to a value of $(2^n-1)R$ (R is a constant value). As a result, a serial connection of the resistor element RD for the detection of the attachment of the nth cartridge ICn to the resistor element RBn forms a resistor with a resistance of $2^nR$. A resistor that has a resistance of $2^nR$ and corresponds to the nth (n is in a range of 1 to N) cartridge is connected in parallel to the attachment detector 330. Combined resistors 701 to 704 that are formed by serial connections of the resistor elements RD for the detection of attachment to the resistor elements RB1 to RB4 are also referred to as "resistors".

When a bias voltage that is applied to the attachment detector 330 is indicated by VREF, the value of a current IDET that is detected by the attachment detector 330 is a value ((VHO−VREF)/Rc) obtained by dividing a voltage of (VHO−VREF) by a combined resistance Rc of the four resistors 701 to 704. When the number of cartridges is N, and all the N cartridges are attached, the detected current IDET is represented by the following Equations (1) and (2).

$$I_{DET} = \frac{VHO - VREF}{R_c} \quad (1)$$

$$R_c = R\frac{1}{\sum_{j=1}^{N}\frac{1}{2^j}} \quad (2)$$

When one or more cartridges are not attached, the combined resistance Rc increases and the detected current IDET is reduced in accordance with the number of the cartridges that are not attached.

FIG. 9B illustrates relationships between the detected current IDET and attached or unattached states of the cartridges IC1 to IC4. In FIG. 8B, the abscissa indicates sixteen patterns of attached or unattached states of the cartridges IC1 to IC4, while the ordinate indicates a value of the detected current IDET for each of the patterns of the states of the cartridges IC1 to IC4. The sixteen patterns of the states of the cartridges IC1 to IC4 correspond to sixteen combinations obtained by selecting one to four cartridges from among the four cartridges IC1 to IC4. Each of the combinations is also referred to as a "subset". The values of the detected current IDET uniquely identify the sixteen patterns of the states of the cartridges IC1 to IC4. In other words, the resistances of the four resistors 701 to 704 corresponding to the four cartridges IC1 to IC4 are set so that the sixteen patterns of the states of the four cartridges IC1 to IC4 lead to different combined resistances Rc.

When all the four cartridges IC1 to IC4 are in the attached states, the detected current IDET has the maximum value Imax among the values of the detected current IDET. On the other hand, when only the cartridge IC4 that corresponds to the resistor 704 with the largest resistance is unattached, the value of the detected current IDET is 0.93 times the maximum value Imax. Thus, by detecting whether or not the value of the detected current IDET is equal to or higher than a threshold Ithmax that is between the aforementioned two current values, it is possible to detect whether or not all the four cartridges IC1 to IC4 have been attached. Note that the voltage VHO that is higher than a power supply voltage of approximately 3.3 V of the normal logic circuit is used so as to increase a dynamic range of the detected current IDET and thereby improve the accuracy of detection of the attachment.

The attachment detector 330 converts the detected current IDET into a digital detection signal SIDET and transmits the digital detection signal SIDET to the CPU 410 (illustrated in FIG. 4). The CPU 410 can determine the current attachment state from among the sixteen patterns of the states of the cartridges on the basis of a value of the digital detection signal SIDET. When the CPU 410 determines that one or more cartridges are not attached, the CPU 410 causes the display unit 430 to display information (characters and/or an image) of the unattached state and informs the user of the unattached state.

In the process of detecting the attachment of the cartridges, the combined resistance Rc is uniquely determined corresponding to the state among $2^N$ patterns of attached or unattached states of the N cartridges and the detected current IDET is uniquely determined in accordance with the combined resistance Rc. It is assumed that acceptable errors of the combined resistance of the resistors 701 to 704 are ±ϵ. It is assumed that a first combined resistance of the cartridges IC1 to IC4 when all the cartridges IC1 to IC4 are attached is Rc1 and a second combined resistance of the cartridges IC1 to IC3 when only the cartridge IC4 is unattached is Rc2. Based on this assumption, a relationship of Rc1<Rc2 is established (refer to FIG. 9B). It is preferable that the relationship of Rc1<Rc2 be satisfied when the combined resistance of the resistors 701 to 704 varies in the acceptable error range of ±ϵ. In the worst-case condition, the first combined resistance Rc1 is the maximum value Rc1max in the range of the first combined resistance Rc1 and the second combined resistance Rc2 is the minimum value Rc2min in the range of the second combined resistance Rc2 in consideration of the acceptable errors ±ϵ. In order to identify the combined resistances Rc1max and Rc2min, it is sufficient if the relationship of Rc1max<Rc2min is satisfied. The following Formula (3) is derived from the relationship of Rc1max<Rc2min.

$$\varepsilon < \frac{1}{4(2^{N-1} - 1)} \quad (3)$$

When the acceptable errors ±ϵ satisfy Formula (3), it is ensured that the combined resistance Rc is uniquely determined in accordance with the attached or unattached states of the N cartridges and the detected current IDET is uniquely determined corresponding to the combined resistance Rc. It is, however, preferable that the acceptable error ϵ of the actually designed combined resistance be smaller than the value of the right-hand side of Formula (3). In addition, the acceptable error ϵ of the combined resistance of the resistors 701 to 704 may be set to a sufficiently small value, for example, a value of 1% or smaller without the aforementioned consideration.

Figure 10:
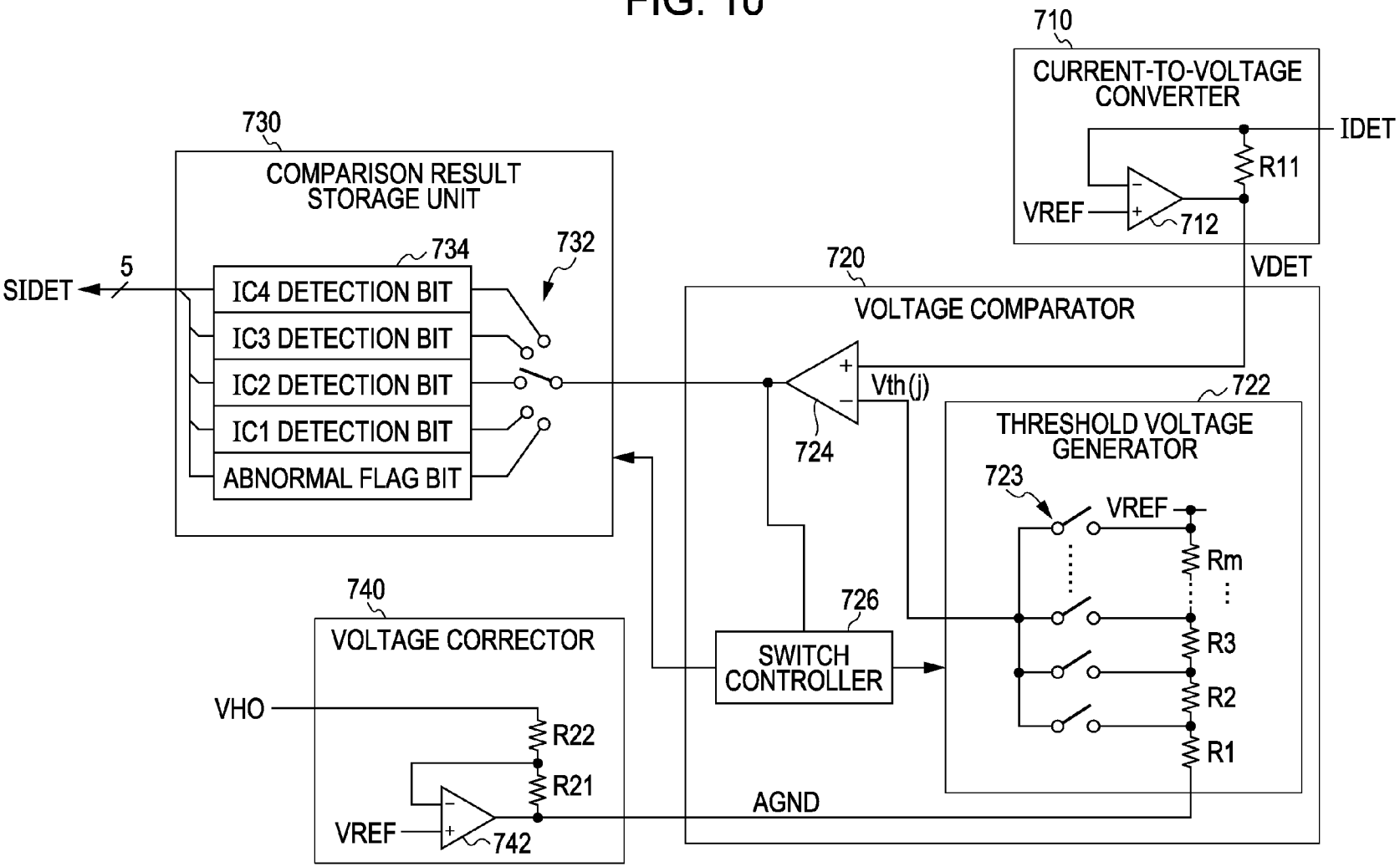
FIG. 10 is a diagram illustrating an example of a detailed configuration of an attachment detector.

FIG. 10 illustrates an example of a detailed configuration of the attachment detector 330 of the printing device 1000 according to the embodiment. The attachment detector 330 includes a current-to-voltage converter 710, a voltage comparator 720, a comparison result storage unit 730 and a voltage corrector 740. The configuration of the attachment detector 330 according to the embodiment is not limited to the configuration illustrated in FIG. 9 and may be variously modified. Some of the constituent elements of the attachment detector 330 may be omitted or replaced with other constituent elements. Other constituent elements may be added to the attachment detector 330.

The current-to-voltage converter 710 is an inverting amplifier circuit that includes an operational amplifier 712 and a feedback resistor R11. A voltage VDET that is output from the operational amplifier 712 is represented by the following Equation (4).

$$\begin{aligned} V_{DET} &= VREF - I_{DET} \cdot R11 \\ &= VREF - (VHO - VREF)\frac{R11}{R_c} \end{aligned} \quad (4)$$

In Equation (4), VHO is the voltage output from the voltage applying unit 320 (illustrated in FIG. 4), and RC is the combined resistance of the four resistors 701 to 704 (illustrated in FIG. 9A). The value of the voltage VDET corresponds to the detected current IDET.

The voltage VDET that is represented by Equation (4) is a voltage obtained by inverting a voltage (IDET R11) determined by the detected current IDET. An inverting amplifier may be added to the current-to-voltage converter 710 so that the current-to-voltage converter 710 outputs a voltage that is obtained by inverting the voltage VDET by the added inverting amplifier. It is preferable that an absolute value of an amplification factor of the added inverting amplifier be 1.

The voltage comparator 720 has a threshold voltage generator 722, a comparator (operational amplifier) 724 and a switch controller 726. The threshold voltage generator 722 uses a switch 723 to select one of a plurality of threshold voltages Vth(j) obtained by dividing the reference voltage VREF by a plurality of resistors R1 to Rm and outputs the selected threshold voltage. The plurality of threshold voltages Vth(j) correspond to thresholds that identify values, corresponding to the sixteen patterns (illustrated in FIG. 9B) of the attached or unattached states of the cartridges, of the detected current IDET. The comparator 724 compares the voltage VDET output from the current-to-voltage converter 710 with the threshold voltage Vth(j) output from the threshold voltage generator 722 and outputs a binary result of the comparison.

The switch controller 726 controls, on the basis of the result of the comparison of the output voltage VDET with the threshold voltage Vth(j), switching of a threshold voltage Vth(j) that will be subsequently output from the threshold voltage generator 722.

The comparison result storage unit 730 sets a flag (for example, writes 1) in an appropriate bit position included in a bit register 734 on the basis of the binary comparison result output from the voltage comparator 720. The switch controller 726 specifies a time for the switching that is performed by a switch 732. The bit resister 734 includes N (N=4 in this example) cartridge detection bits and an abnormal flag bit. The cartridge detection bits indicate whether or not the cartridges that can be attached to the printing device are in the attached states. The abnormal flag bit indicates that an abnormal current value has been detected. The abnormal flag bit is set to a high (H) level when a significantly large amount of current flows, compared with the value Imax (illustrated in FIG. 9B) of the current flowing when all the cartridges are in the attached states. The abnormal flag bit, however, may be omitted. The attachment detector 330 transmits the plurality of bits stored in the bit resister 734 as the digital detected signal SIDET (detected current signal) to the CPU 410 (illustrated in FIG. 4) of the main controller 400. The CPU 410 determines, on the basis of the bit values of the digital detected signal SIDET, whether or not the cartridges have been attached. As described above, the four bit values of the digital detected signal SIDET indicate whether or not the cartridges have been attached. Thus, the CPU 410 can immediately determine, on the basis of the bit values of the digital detected signal SIDET, whether or not the cartridges have been attached.

The voltage comparator 720 and the comparison result storage unit 730 form an analog-to-digital (AD) converter. Known other configurations can be used as the analog-to-digital converter, instead of the voltage comparator 720 and the comparison result storage unit 730 (illustrated in FIG. 10).

The voltage corrector 740 is a circuit that corrects, in response to a variation in the voltage VHO for the detection of attachment, the plurality of threshold voltages Vth(j) generated by the threshold voltage generator 722. The voltage corrector 740 is an inverting amplifier circuit that includes an operational amplifier 742 and two resistors R21 and R22. The voltage VHO that is output from the voltage applying unit 320 is input to an inverting input terminal of the operational amplifier 742 through the resistor R22. The reference voltage VREF is input to a non-inverting input terminal of the operational amplifier 742. A voltage AGND that is output from the operational amplifier 742 is represented by the following Equation (5).

$$AGND = VREF - (VHO - VREF)\frac{R21}{R22} \tag{5}$$

The voltage AGND is used as a standard voltage AGND to be applied to a low-voltage-side part of the threshold voltage generator 722. For example, when the voltage VREF is 2.4 V, the voltage VHO is 42 V, the resistor R21 has a resistance of 20 kΩ and the resistor R22 has a resistance of 400 kΩ, the voltage AGND is 0.42 V. As can be understood from the comparison of Equation (4) with Equation (5), the standard voltage AGND that is applied to the low-voltage-side part of the threshold voltage generator 722 varies in accordance with the voltage VHO output from the voltage applying unit 320 in a similar manner to the detected voltage VDET. The difference between the two voltages AGND and VDET results from the difference between the resistance ratio of R21/R22 and the resistance ratio of R11/Rc. When the voltage corrector 740 is used and the power supply voltage VHV varies for some reason, the threshold voltages Vth(j) that are generated by the threshold voltage generator 722 vary in accordance with the variation in the power supply voltage VHV. As a result, the detected voltage VDET and the threshold voltages Vth(j) vary in accordance with the variation in the power supply voltage VHV. Thus, the voltage comparator 720 can output an accurate comparison result that indicates the attached or unattached states of the cartridges. When the resistance ratio of R21/R22 and the resistance ratio of R11/Rc1 (Rc1 is the combined resistance when all the cartridges are in the attached states) are set to be equal to each other, the detected voltage VDET and the threshold voltages Vth(j) can vary in accordance with the variation in the power supply voltage VHV so that a change in the detected voltage VDET and changes in the threshold voltages Vth(j) are nearly equal to each other. The voltage corrector 740 may be omitted.

As described above, when a plurality of ink cartridges are used in the printing device according to the embodiment, the printing device can detect that an ink cartridge is not attached to the printing device. If a short circuit has occurred between terminals of an ink cartridge during the detection of the attachment, the printing device can detect the short circuit and stop supply of a high voltage to be used for the detection of the attachment. In addition, since the printing device can stop an application of a high voltage during access to the storage device, the printing device can suppress the occurrence of noise. As a result, the printing device that can reliably and safely detect the attachment of ink cartridges can be achieved.

The control that is performed by the sub-controller 350 and necessary to detect attachment and ejection of ink cartridges, detect a short circuit, block the supply of the high voltage and the like may be performed by the main controller 400.

The embodiment is described above in detail. It will be understood by those skilled in the art that various changes and modifications can be made herein without materially departing from the new matters and effects of the invention. Thus, such changes and modifications are all included in the scope of the invention. For example, terms that are described together with broader or synonymous different terms at least once in this specification or the drawings can be replaced with those different terms in any section of the specification and the drawings. The configuration and operations of the printing device are not limited to those described in the embodiment, and can be variously modified.

The entire disclosure of Japanese Patent Application No. 2011-182236, filed on Aug. 24, 2011 is expressly incorporated herein by reference.

What is claimed is:

1. A printing device comprising:

a printing material container that includes a storage device for storing information of a printing material, a plurality of terminals for the storage device, a first attachment detection terminal and a second attachment detection terminal;

a controller that is connected to the plurality of terminals for the storage device and controls reading or writing of data from or in the storage device;

a voltage applying unit that applies a voltage for detection of attachment to the first attachment detection terminal; and a short circuit detector, wherein when the voltage applying unit applies the voltage for the detection of the attachment to the first attachment detection terminal, the controller sets the plurality of terminals for the storage device to a high impedance state, wherein the printing material container further includes a first short circuit detection terminal and a second short circuit detection terminal, and wherein the short circuit detector is connected directly to the first and second short circuit detection terminals or connected through a circuit element to the first and second short circuit detection terminals and detects a short circuit between at least one of the first and second short circuit detection terminals and at least one of the first and second attachment detection terminals.

2. The printing device according to claim 1, wherein before accessing the storage device, the controller sets the plurality of terminals for the storage device from the high impedance state to a certain voltage level.

3. The printing device according to claim 2, wherein after the plurality of terminals for the storage device are set to the certain voltage level, the controller reads or writes the data from or in the storage device by setting the plurality of terminals for the storage device from the certain voltage level to a predetermined voltage level.

4. The printing device according to claim 1, further comprising an attachment detector, wherein the printing material container further includes a resistor element for the detection of the attachment between the first and second attachment detection terminals, and wherein the attachment detector detects the attachment of the printing material container on the basis of a current flowing in the resistor element.

5. The printing device according to claim 1, wherein the voltage for the detection of the attachment is higher than a high-potential-side power supply voltage that is supplied to the storage device.

6. The printing device according to claim 1, wherein the printing material container has a circuit board on which the plurality of terminals for the storage device, the first and second attachment detection terminals, and the first and second short circuit detection terminals are mounted, and wherein the plurality of terminals for the storage device are arranged in a region that is located on a surface of the circuit board and surrounded by the first and second attachment detection terminals and the first and second short circuit detection terminals.

7. A printing device comprising:

a printing material container that includes a storage device for storing information of a printing material, a plurality of terminals for the storage device, a first attachment detection terminal and a second attachment detection terminal;

a controller that is connected to the plurality of terminals for the storage device and controls reading or writing of data from or in the storage device; and a voltage applying unit that applies a voltage for detection of attachment to the first attachment detection terminal, wherein when the voltage applying unit applies the voltage for the detection of the attachment to the first attachment detection terminal, the controller sets the plurality of terminals for the storage device to a high impedance state, wherein before accessing the storage device, the controller sets the plurality of terminals for the storage device from the high impedance state to a certain voltage level, wherein after the plurality of terminals for the storage device are set to the certain voltage level, the controller reads or writes the data from or in the storage device by setting the plurality of terminals for the storage device from the certain voltage level to a predetermined voltage level, and wherein before the controller reads or writes the data from or in the storage device, the voltage applying unit stops the application of the voltage for the detection of the attachment.

8. The printing device according to claim 7, wherein after completing the reading or writing of the data from or in the storage device, the controller sets the plurality of terminals for the storage device to the certain voltage level, and wherein after the plurality of terminals for the storage device are set to the certain voltage level, the voltage applying unit applies the voltage for the detection of the attachment to the first attachment detection terminal, and the controller sets the terminals for the storage device are to the high impedance state.

* * * * *